United States Patent [19]

Klos et al.

[11] Patent Number: 4,740,277

[45] Date of Patent: Apr. 26, 1988

[54] SULFATE CONTAINING BATH FOR THE ELECTRODEPOSITION OF ZINC/NICKEL ALLOYS

[75] Inventors: Klaus-Peter Klos; Karl-Heinz Lindemann; Hermann Donsbach, all of Trebur, Fed. Rep. of Germany

[73] Assignee: Elektro-Brite GmbH, Trebur, Fed. Rep. of Germany

[21] Appl. No.: 56,548

[22] Filed: May 29, 1987

[30] Foreign Application Priority Data

Jun. 9, 1986 [DE] Fed. Rep. of Germany ..... 3619386

[51] Int. Cl.[4] ..... C25D 3/56

[52] U.S. Cl. ..... 204/44.2

[58] Field of Search ..... 204/44.2, 44.5

[56] References Cited

U.S. PATENT DOCUMENTS 4,699,696 10/1987 Combs et al. ..... 204/44.2

*Primary Examiner*—G. L. Kaplan

*Attorney, Agent, or Firm*—Kurt Kelman

[57] ABSTRACT

Bright electrodeposits of zinc/nickel alloys onto iron of fine crystalline structure are obtained by using an acidic bath containing the sulfates of zinc and nickel, alkali metal acetate and brightening agents, the brightening agents being (1) citric acid, (2) hexin-3-diol-2,5 and (3) naphthalene sulfonic acid having 1 to 3 sulfo groups which is optionally substituted by one or two $C_1$-$C_4$-alkyl groups and halogen atoms, respectively or a condensation product thereof with formaldehyde.

2 Claims, No Drawings

SULFATE CONTAINING BATH FOR THE ELECTRODEPOSITION OF ZINC/NICKEL ALLOYS

The invention relates to an acidic sulfate containing bath for the electrodeposition of zinc/nickel—alloys onto iron substrates.

From a lecture of A. Komoda et al. "Zn-Ni alloy plating at high current densities" at American Electroplater's Society Symposium Chicago, May 1 to 3, 1984, pages 1—29 it is known that zinc/nickel alloys which are electrodeposited onto iron from a chloride containing acidic solution having a content of 10 to 16% by weight of nickel show a single phase$\gamma$-crystal structure and exhibit a more than five-fold better corrosion resistance in the salt spray test as compared to zinc electrocoated iron. When using insoluble anodes, however, chlorine is developed in the anode space of a chloride containing bath which renders the use of such anodes inoperable. For this reason insoluble anodes can only be used with chlorine-free sulfate containing electrolytes. On the other hand insoluble anodes provide an electrodeposit of constant quality because of the fixed distance between cathode and anode in the electrolytic cell. The use of sulfate containing electrolytes has the disadvantage that the metal content of the deposited alloy, in particular of nickel, depends from the $p_H$ (range 1.5 to 3) as well as from the temperature (range 50° C. to 60° C.). However, by using insoluble anodes steel strip can be electrocoated with a zinc/nickel alloy of equal quality with very high cathode speeds up to 150 m/min.

Both types of bath have the disadvantage that the electrodeposits of zinc/nickel alloy are brittle, have a colour ranging from grey to dark and are of a rough crystalline structure and are not easily passivated by chromium treatment.

Object of the invention is to provide a bath for electrodepositing zinc/nickel alloys onto iron that avoids these aforementioned disadvantages.

It has been found that certain brighteners in a certain combination, if used in certain amounts give highly lustrous fine crystalline electrodeposits. This was surprising considering that each of the additives as such doesn't give the effect reached by the invention with sulfate containing zinc/and nickel containing electroplating baths because of secondary effects like foaming, decomposition at high current densities and the like.

The acidic sulfate containing bath for electrodepositing zinc/nickel - alloy onto iron containing 0.4 to 1.0 mol/liter of zinc and 0.8 to 2.0 moles/liter of nickel as sulfates, 0.08 to 0.2 mole/liter alkali/metal acetate and brighteners of the invention is characterised in that it contains as brighteners:

(1) 0.18 to 0.35 mole/liter citric acid
(2) 0.1 to 2.0 gs/liter hexin-3-diol-2,5 and
(3) 0.1 to 2.0 gs/liter of a naphthalene sulfonic acid with 1 to 3 sulfo groups and optionally 1 or 2 $C_1$–$C_4$-alkyl groups and halogen atoms, respectively as substituents, or a condensation product thereof with formaldehyde.

Preferably the bath of the invention contains the following brighteners:

(1) 0.2 to 0.3 mole/liter of citric acid
(2) 0.5 to 1.0 gs/liter of hexin-3-diol-2,5 and
(3) 0.5 to 1.5 gs/liter of naphthalene-1-sulfonic acid.

The preferred naphthalene sulfonic acids are the mono -, di - and trisulfonic acids of naphthalene or the condensation products thereof with formaldehyde.

The invention is illustrated by the following examples:

EXAMPLE I

A bath is prepared by mixing the following ingredients and, after having added all constituents, adding distilled water up to 1 liter:

BASIC BATH

Zinc sulfate $0.7H_2O$: 162 gs/l (0.56 mol/l=36.6 g of zinc)
Nickel sulfate $0.7H_2O$: 316 gs/l (1.13 mol/l=66.3 g/l nickel
Sodium acetate: 10 gs

BRIGHTENERS OF THE INVENTION

Citric acid: 5 gs/l
Hexin-3-diol-2,5: 0.2 g/l
Naphthalene sulfonic acid formaldehyde condensation product: 0.5 g/l Steel strip of 2 cm width and 2 mm thickness was electrocoated with a zinc/nickel alloy from the bath at a current density of about 50 Amps/dm$^2$. The strip was drawn continuously through the bath with a speed of about 50 m/min, acting as cathode. The anode consisted of lead and graphite, respectively. The bath temperature was 60° C.

There was obtained a wiping-proof highly lustrous fine grained electrodeposit about 3 nm thick which showed in the salt spray chamber a rust area of 5 to 10% only after 20 days whereas a steel strip electrocoated with zinc only showed 100% corrosion in the same test.

EXAMPLE II

The basic bath of Example I was used, with the following brighteners:

Brighteners of the invention:
Citric acid: 0.5 g/l
Hexin-3-diol-2,5: 1.0 g/l
Naphthalene trisulfonic acid formaldehyde condensate: 1.2 g/l When applied to steel strip as in Example I very dense, lustrous electrodeposits were obtained. In the salt spray test the following corrosion values were obtained after 10 days:

(a) Basic bath with brighteners of the invention: 2 to 5% of the area corroded.
(b) Comparative bath 1: basic zinc and nickel containing bath without additives: 15% of the area corroded.
(c) Comparative bath 2: zinc bath without additives: 90% of the area corroded.

We claim:

1. An acidic sulfate containing zinc and nickel containing bath for the electrodeposition of lustrous zinc-/nickel alloy coatings onto iron, containing 0.4 to 1.0 mol/liter of zinc and 0.8 to 2.0 mol/liter of nickel as sulfates, 0.08 to 0.2 mol/liter of alkali metal acetate and brighteners characterised in that it contains as brighteners:

(1) 0.18 to 0.35 mol/liter of citric acid
(2) 0.1 to 2.0 gs/liter of hexin-3-diol-2,5 and
(3) naphthalene sulfonic acid with 1 to 3 sulfo groups and optionally 1 or 2 $C_1$–$C_4$-alkyl groups and halogen atoms, respectively as substituents or condensation products thereof with formaldehyde.

2. Zinc and nickel containing bath as claimed in claim 1 characterized in that it contains as brighteners:

(1) 0.2 to 0.3 mol/liter of citric acid
(2) 0.5 to 1.0 gs/liter of hexin-3-diol-2,5 and
(3) 0.5 to 1.5 gs/liter of naphthalene sulfonic acid.

* * * * *